United States Patent [19]

Miller

[11] Patent Number: 4,791,769

[45] Date of Patent: Dec. 20, 1988

[54] MOVABLE HEAT CHAMBER INSULATING STRUCTURE

[75] Inventor: Thomas M. Miller, North Olmsted, Ohio

[73] Assignee: ELTECH Systems Corporation, Boca Raton, Fla.

[21] Appl. No.: 711,387

[22] Filed: Mar. 13, 1985

Related U.S. Application Data

[63] Continuation-in-part of Ser. No. 602,197, Apr. 19, 1984, abandoned.

[51] Int. Cl.[4] ..... E04B 1/38

[52] U.S. Cl. ..... 52/511; 52/506; 110/336; 156/227; 428/121; 428/920

[58] Field of Search ..... 428/121, 124, 920; 52/506, 509, 511; 110/336; 156/210, 227

[56] References Cited

U.S. PATENT DOCUMENTS

| | | | |
|---|---|---|---|
| 2,987,856 | 6/1961 | Longenecker | 50/429 |
| 3,030,737 | 4/1962 | Deming | 50/391 |
| 3,832,815 | 9/1974 | Balaz et al. | 52/227 |
| 3,854,262 | 12/1974 | Brady | 52/404 |
| 3,952,470 | 4/1976 | Byrd, Jr. | 52/509 |
| 3,990,203 | 11/1978 | Greaves | 52/227 |
| 4,001,996 | 1/1977 | Byrd | 428/121 |
| 4,088,825 | 5/1978 | Carr | 13/25 |
| 4,103,469 | 8/1978 | Byrd | 428/121 |
| 4,123,886 | 11/1978 | Byrd | 428/234 |
| 4,183,305 | 1/1980 | Payne | 110/173 |
| 4,194,282 | 3/1980 | Byrd, Jr. | 29/451 |
| 4,222,337 | 9/1980 | Christiansen | 110/336 |
| 4,287,839 | 9/1981 | Severin et al. | 110/331 |
| 4,318,259 | 3/1982 | Verheyden | 52/404 |
| 4,336,086 | 6/1982 | Rast | 156/71 |
| 4,339,902 | 7/1982 | Cimochowski | 428/121 |
| 4,411,621 | 10/1983 | Miller | 432/247 |
| 4,425,749 | 1/1984 | Parker | 52/509 |
| 4,605,583 | 8/1986 | Frahme | 52/506 |
| 4,633,637 | 1/1987 | Frahme | 52/506 |
| 4,640,202 | 2/1987 | Schraff et al. | 52/506 |

FOREIGN PATENT DOCUMENTS

| | | |
|---|---|---|
| 2345409 | 1/1977 | France . |
| 2387429 | 4/1978 | France . |
| 2454071 | 4/1979 | France . |
| 2042699 | 9/1980 | United Kingdom . |
| 2095382 | 9/1982 | United Kingdom . |
| 2112119 | 7/1983 | United Kingdom . |

*Primary Examiner*—James J. Bell

*Attorney, Agent, or Firm*—John J. Freer

[57] ABSTRACT

An insulation structure for a heat chamber, e.g., a wall or ceiling for a furnace, is now supported and linked to a frame in a manner providing for ease of repair plus simplicity of maintenance. In one embodiment a series of side-by-side ceramic fiber blankets can be maintained in snug relationship, in part by adjustable compression means. Heat loss, which can otherwise be caused by heat induced ceramic fiber shrinkage, is now substantially reduced to eliminated by the manner of supporting the insulation structure coupled with the compression exerted against such structure.

55 Claims, 9 Drawing Sheets

MOVABLE HEAT CHAMBER INSULATING STRUCTURE

CROSS-REFERENCE TO RELATED APPLICATION

This application is a continuation-in-part of U.S. patent application Ser. No. 602,197 filed Apr. 19, 1984 now abandoned.

BACKGROUND OF THE INVENTION

Ceramic fiber insulating material has been found useful when woven in fibrous form into mats or blankets. Although the material had desirable insulation characteristics it was found early on to lack significant mechanical strength as well as having poor structural qualities. Also at more elevated temperatures, such as about 2000° F. (1090° C.) or higher, the fiber blankets exhibit shrinkage. To compensate for these drawbacks, it has been proposed to form groups of individual batts into prefabricated modules. Then, such as shown in U.S. Pat. No. 3,832,815, the modules could be comprised of a series of individual side-by-side batts arranged in parallel, which could be crimped together at the cold face in module formation. This permitted the hot face portion of the batt module to flare out, thereby helping to compensate for the heat-induced individual blanket shrinkage.

It was also proposed to fold blankets, such as in U-shaped configurations, and hold them by support members within the fold. In U.S. Pat. No. 3,952,470, suspension arms with pointed tabs engage the support. The pointed tabs are pushed through the blanket for affixing to outer support means. By jamming the blankets together, and then folding the pointed tabs down over the support means, a flaring effect is achieved such as mentioned hereinbefore, for compensating heat-induced blanket shrinkage.

It has also been proposed to crimp or pinch side-by-side ceramic fiber blankets at the cold-face in a manner essentially providing support for the blankets by the crimping. Thus, U.S. Pat. No. 3,990,203 suggests such a festure combined with other support means which can form, when clamped together, self-supporting wall panels. In another variation, compression assisted by stacking of blankets has been proposed. Thus, in U.S. Pat. No. 4,088,825 the ceramic fiber batts are stacked and then compressed on their cold-face, in a structure promoted for use in an electric furnace wall construction. In another alternative, fiber strips can be held together by tubes and then adhered to a base plate with refractory adhesive. Then, as shown in U.S. Pat. No. 4,318,259, the plates can be pulled together and held firmly in place in an effort to close the seams between adjacent plates.

Other techniques that have been recently employed include folding of blankets in various configurations and pressing them onto hooks to compress the blankets into insulation rolls. Such configuration has been disclosed in U.S. Pat. No. 4,336,086. Also blankets can be squeezed into and against one another such as in alternating and overlapping U-shaped mats, as shown in U.S. Pat. No. 4,411,621. Or fibrous strips can be stacked flat and compressibly held down by anchor members firmly affixed to a furnace wall, such as discussed in U.S. Pat. No. 4,222,337.

In various of these structures, the replacement of individual blankets, or of modules, is also a consideration. For example in U.S. Pat. No. 4,411,621 individual U-shaped mat units at the interior of the furnace lend themselves to ease of replacement. In U.S. Pat. No. 4,287,839 individual blocks comprising an insulating mat folded in corrugated manner are designed for ease of replacement. By use of special cold-face structural plate configurations, with suspension hooks used as attaching means, the individual insulating blocks can be replaced from outside the furnace. By means of differing elements individual panels can be interlocked to form a self-supporting structure. Such a structure, as discussed in the above-mentioned U.S. Pat. No. 3,990,203, has the added feature of providing a portable chamber lining.

It would however be desirable to provide for a wall structure providing great ease of blanket or batt replacement. It would also be desirable to combine this with compression of the blankets or batts. An added advantage would be most simplistic ease in replacing sections even during heat chamber operation. Such features would best be combined with shrinkage compensating compression on the blankets, that would automatically adjust as shrinkage is encountered at high temperatures, and even for operations involving a range of elevated temperatures.

SUMMARY OF THE INVENTION

These above-discussed advantages together with other special features have now been achieved in an easily constructed, lightweight wall-type structure. The structure can comprise a series of unitized mats of ceramic fiber insulating material at the hot face of the structure. The mats can be arranged such that heat path joints between adjacent mats are perpendicular to the chamber and may therefor lead to heat travel through the wall. In such structure heat escape is an especially troublesome problem. Means have now been assembled for reducing to eliminating such heat loss even under these troublesome conditions.

Moreover, such heat loss savings have been accomplished in an overall lightweight and economical wall or cover structure. Furthermore, one of the particularly costly problems associated with any such wall involves repair. A structure has now been provided that not only lends itself to economy and ease of repair but, most noteworthy, such repair can often be made even to individual blankets while the heat chamber is in operation. No other wall or cover structure for a heat chamber is known which offers such a unique combination of features.

In general, the present invention relates to an insulation structure for retaining heat in a heat zone, such structure having an inner ceramic fiber hot face, which structure comprises ceramic fiber insulation in form-stable condition; support means in interengagement with such insulation; frame means adjacent the insulation; linking means engaging the support means with the frame means in movable engagement; and adjustable compression means abutting against the insulation.

In another aspect the invention comprises a method for assembling an insulating structure in a manner facilitating ease of repair while being adapted for reducing heat loss. In yet other aspects the invention comprises a novel corner insulating structure for a heating chamber, a novel fiber insulation repair module, an innovative cover structure for such a chamber, as well as novel furnace designs and method for their repair or reconstruction.

DESCRIPTION OF THE PREFERRED EMBODIMENTS

Ceramic fiber insulation will be useful for purposes of the present invention so long as it is available in some form-stable condition, i.e., as opposed to merely loose fibers. To provide form-stable condition, it can be expected that individual fibers will have been brought together in matrix form, such as by a felting or weaving operation or the like. When in such form, the insulation can be supplied in units.

For convenience, individual ceramic fiber insulating units will generally be referred to herein as "blankets", but it is to be understood that the words "batts" and "mats" may also be used to refer to such units. By use of the term ceramic fiber "module" or the like, reference is being made to a blanket unit plus associated blanket support and hanger elements, i.e., a blanket unit and associated "hardware". In the module more than one blanket may be present, e.g., by stitching together adjacent blankets or by interengaging such blankets by inner support means. It is also to be understood that the word "wall", or the term "wall-type", as used herein are meant to include any structure, be it a wall, lid, roof or cover, that presents a generally planar surface to a heating zone and is useful for confining heat within the zone. The wall will provide confinement for a portion of a heat chamber, e.g., a furnace, oven, forge, soaking pit or kiln, and may exist in straight or curvilinear form.

Figure 1:
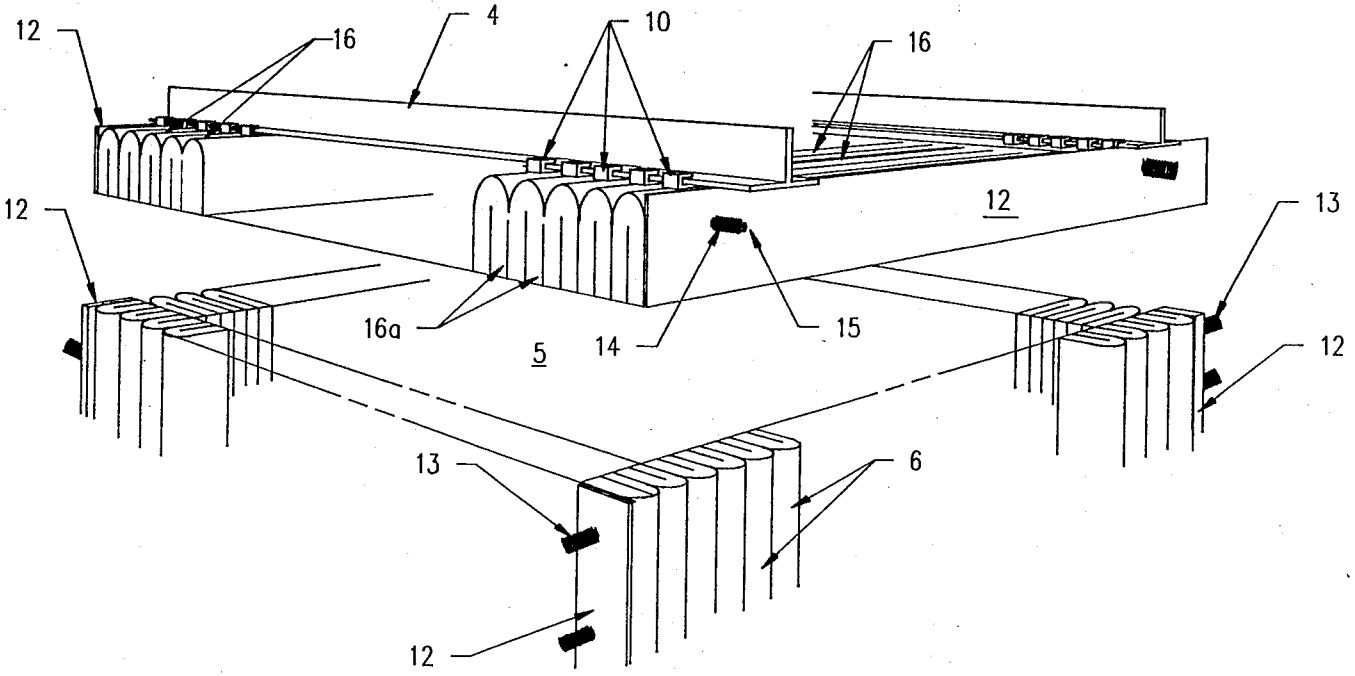
FIG. 1 is a perspective view in partial section of heat chamber walls with a roof shown in exploded section.

Referring now more particularly to FIG. 1, a heat chamber 5 is depicted substantially enclosed by walls, shown in section, each formed from a series of elongated and folded U-shaped mats 6 in parallel. The mats 6 are prepared from ceramic fiber insulating material and are in snug side-by-side relationship, with each being reinforced and linked to guide channels, all by means not shown, such as in a manner as will be hereinafter depicted for example in FIG. 2. By means of the encompassing view of FIG. 4, the disposition of pressure plates 12 are more particularly shown. Each of the pressure plates 12 are compressed against a corner section face of a U-shaped mat 6 by adjustable force means, not shown, transmitted through threaded bolts 13.

As shown in exploded partial section, a roof or cover is positioned over the heat chamber 5. Over the heat chamber 5 depending U-shaped roof blankets 16 are disposed. Each of the U-shaped roof blankets 16 has a pair of depending blanket legs **16*a*. A reinforcing bar, not shown, is retained within the fold of each U-shaped roof blanket 16. To each reinforcing bar there are attached posts, also not shown, which pierce through each roof blanket 16 and terminate in a generally C-shaped grip head 10. The grip heads 10 then serve as sliding hangars, griping in this fashion around a portion of a T-bar 4 in slidable engagement. At each end, the T-bar is held in place, as by welding, to end plates, not shown. A spring loaded compression plate 12 abuts against the roof blankets 16. Pressure is exerted by the spring 14 coiled around posts 15 of the spring loaded compression plate 12. The end plates, not shown, are firmly affixed to the furnace chamber structure, by means not shown. In construction, placement of the roof provides for the resting of the roof blanket leg sections 16*a* upon the upper surface plane of the wall mats 6, thereby providing a covered insulation structure for the heat chamber 5. As will be seen by referring particularly to the C-shaped grip heads 10, their dimension along the T-bar 4 can be sized to provide for limiting the maximum degree of compression of the roof blankets 16**. As will be appreciated by those skilled in the art, the roof structure by itself will be adaptable as a general heat insulation structure, e.g., in use as a soaking pit cover of the like.

Figure 2:
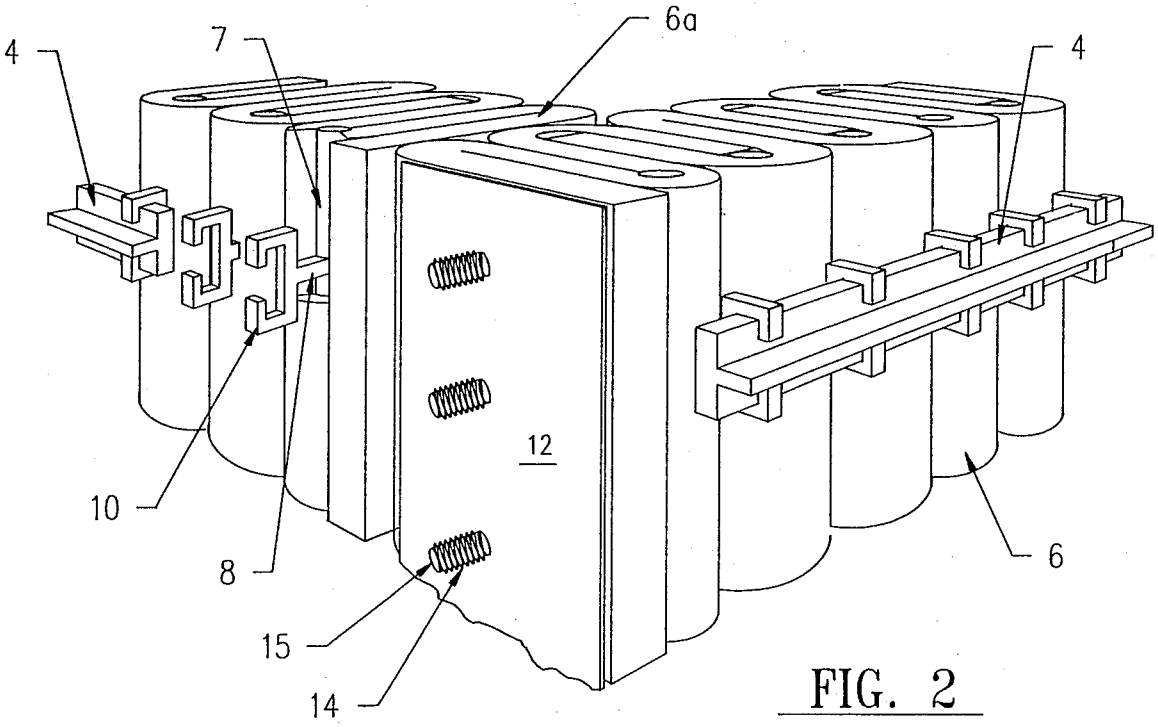
FIG. 2 is a perspective view in partial section of the cold face of an outer corner portion of a furnace wall structure which intersects in a manner in accordance with the present invention.

FIG. 2 shows a form for providing support for the insulation structure. A series of substantially W-shaped ceramic fiber insulation blankets 6 provide insulation by being disposed in parallel, side-by-side relationship. The blankets 6 are arranged in such a manner as to provide interengagement of blanket leg sections **6*a* between adjacent blankets 6. Reinforcing bars 7 are then retained in folds of the blankets 6. To each reinforcing bar 7 there are attached engaging posts 8, each of which pierce through the blanket and terminate in a generally C-shaped grip head 10. The grip heads 10 then grip around a portion of a T-bar 4 in slidable engagement. The T-bar 4** is held firmly in place by support members, not shown.

At the outermost corner of the wall portion, a pressure plate 12 abuts against the first, or cornermost, W-shaped blanket 6, which thereby becomes the corner-forming element of the wall. The pressure plate 12 is compressed against the corner section of this W-shaped blanket 6 by force means, not shown. Pressure exerted through the springs 14 coiled around posts 15 and connecting with means not shown, presses against the cornermost W-shaped blanket 6 thereby compressing all of the W-shaped blankets 6 that are aligned in the direction of the compressive force. In like manner, the adjoining and intersecting wall section is likewise placed under compressive force.

Figure 3:
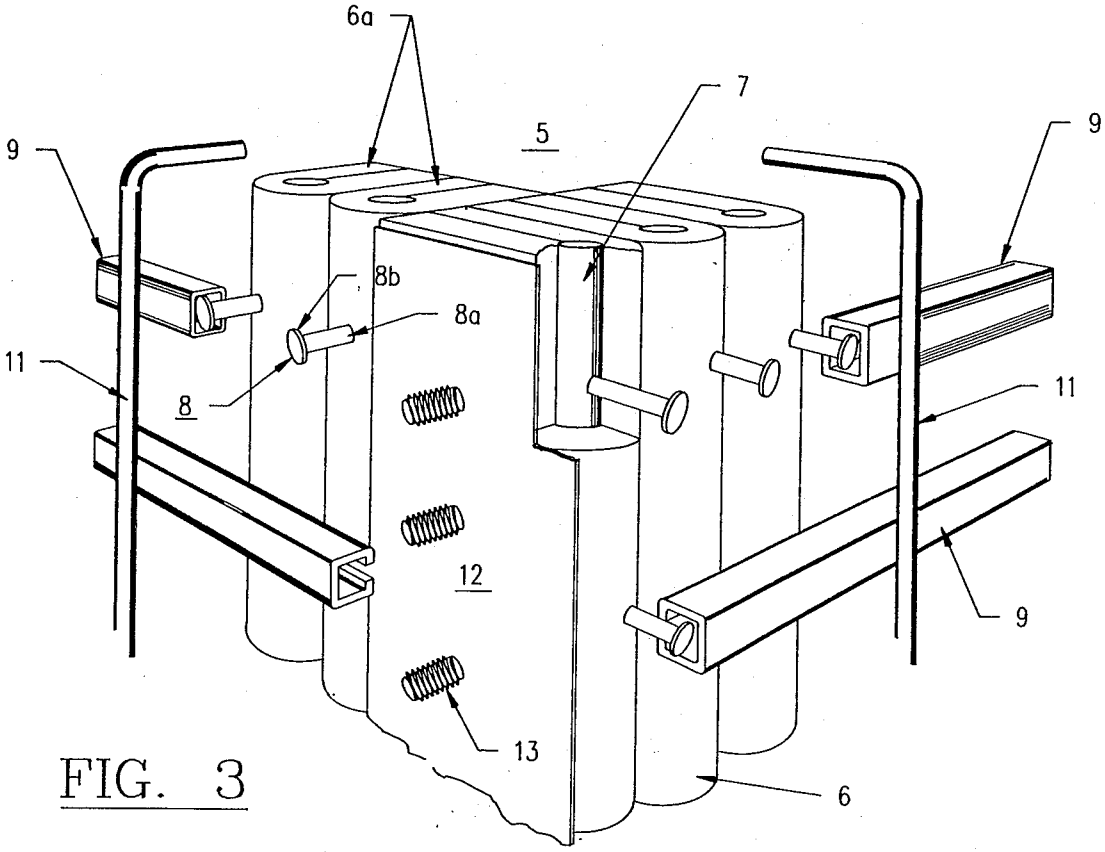
FIG. 3 is a perspective view, in the nature of FIG. 2, showing optional upright engagement of ceramic fiber blanket support means.

A perspective view in partial section of an outer corner portion of intersecting heat chamber walls of different structure has been depicted in FIG. 3. Referring to FIG. 3, the heat chamber walls intersect at a right angle to form a corner for partially enclosing a heat chamber 5. Each intersecting wall section is composed of a series of elongated and folded U-shaped mats 6 arranged such that a major portion of the outer surfaces of a leg section 6*a* of one mat 6 abuts against a leg section 6*a* of an adjacent mat 6. Adjacent individual mats 6, in series, collectively form at least a portion of a heat chamber wall and have their leg sections 6*a* projecting inwardly to the heat chamber 5.

Each individual U-shaped mat 6 is folded around a supportive reinforcing bar 7. To the reinforcing bar 7, a series of engaging posts 8 are affixed. The post leg 8*a* pierces through the fiber at the fold of the mat 6 from the reinforcing bar 7. The post leg 8*a* terminates in a post head 8*b* which is contained within a guide channel 9. Thereby the post 8 links the reinforcing bar 7 with the guide channel 9. The channel 9 forms a portion of the reticulate frame means at the cold face of the heat chamber wall. The guide channels 9 are securely affixed, such as by welding, to support bars 11 which are rigidly held in place to other frame structure of the heat chamber by means not shown. At the outermost corner of the wall portion a pressure plate 12 abuts against the first U-shaped mat 6 of the wall. The pressure plate 12 is compressed against the corner section face of this U-shaped mat 6 by adjustable force means, not shown, transmitted through the threaded sections 13. Compression against the mat 6 thereby compresses all of the adjacent mats 6 that are in side-by-side relationship in the direction of the exerted compressive force. In similar manner, i.e., by means of a pressure plate and compressive means, all not shown, the intersecting wall section is likewise placed under compressive force.

The hot face of the wall is formed at least in part by the leg sections 6*a* of the mats 6. Where adjacent mats 6 form the corner by the end plate 12, some mat leg sections 6*a* from one wall abut up against a mat leg section 6*a* of the mats from the other wall. This engagement, shown in FIG. 3 at a right angle, forms the corner of the heat chamber 5.

Figure 4:
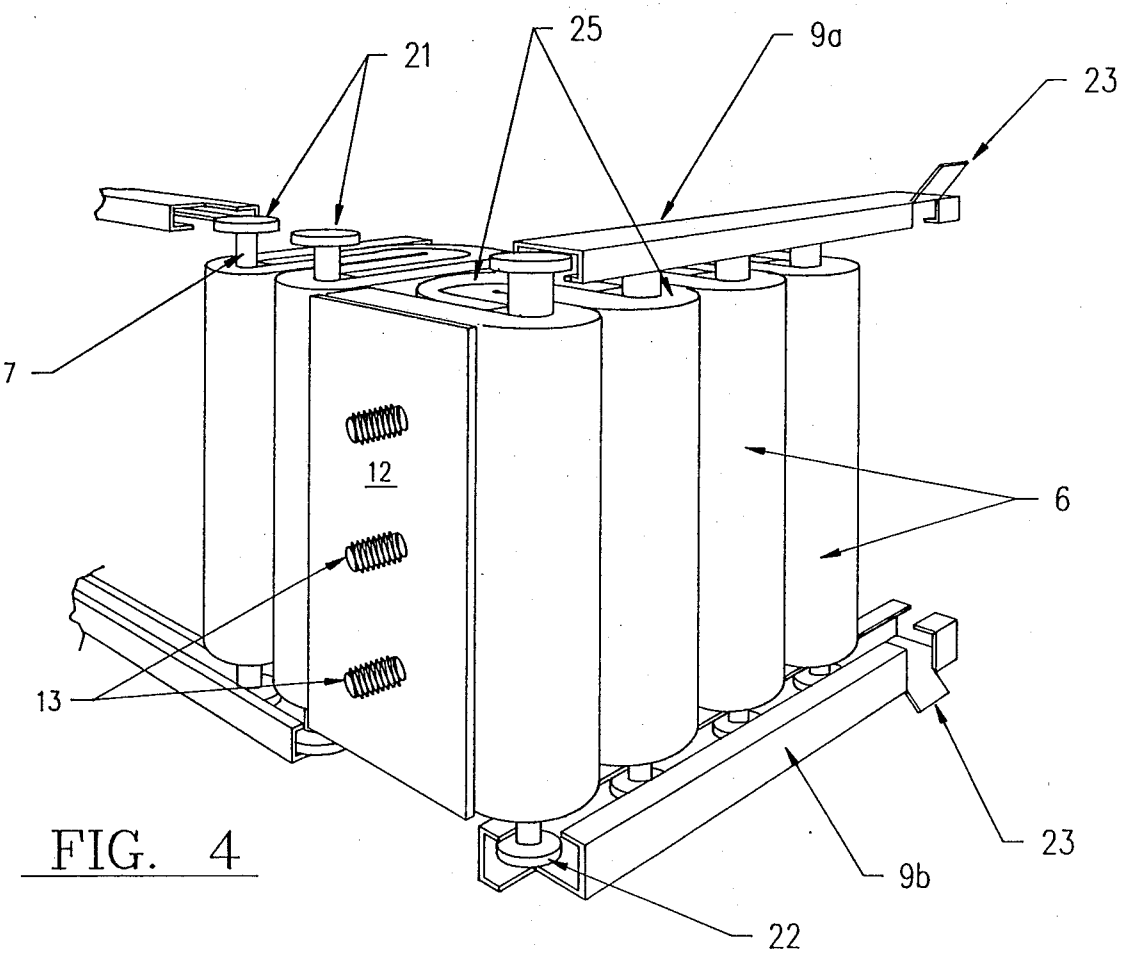
FIG. 4 is a perspective view also in the nature of FIG. 2 and showing a variation in engagement means.

In FIG. 4 there is depicted an alternate form for engaging ceramic fiber insulation with guide channels 9*a*, 9*b*. In the configuration depicted, the insulation is provided by two continuous blanket insulation elements 25 folded in corrugated manner to provide an interengaged, corrugation pattern. At the top of the insulation structure, the reinforcing bars 7 engaged within folds of the continuous blanket insulation elements 25 extend upwardly beyond the upper face of the insulation elements 25 and terminate in a support bar head 21. The head 21 of each reinforcing bar 7 is then engaged in the upper guide channel 9*a*. In similar manner, the foot 22 of each reinforcing bar rests in the lower guide channel 9*b*. Each guide channel 9*a* and 9*b* contains flaps 23 which can be moved aside to facilitate the movement of the reinforcing bars 7 in and out of the guide channels 9*a* and 9*b*. These channels are then held firmly in place to heat chamber structure by means not shown. At the outermost corner of the wall portion, a pressure plate 12 abuts against the cornermost leg of the insulation elements 25. The pressure plate 12 is compressed against the corner leg section face of the insulation elements 25 by adjustable force means, not shown, transmitted through the threaded sections 13. Compression against the cornermost leg section thereby compresses all of the adjacent folded sections of the insulation elements 25 that are in side-by-side relationship in the direction of the exerted compressive force. In similar manner, i.e., by means of pressure plate and compressive means, all not shown, the intersecting wall section is likewise placed under compressive force.

Figure 5:
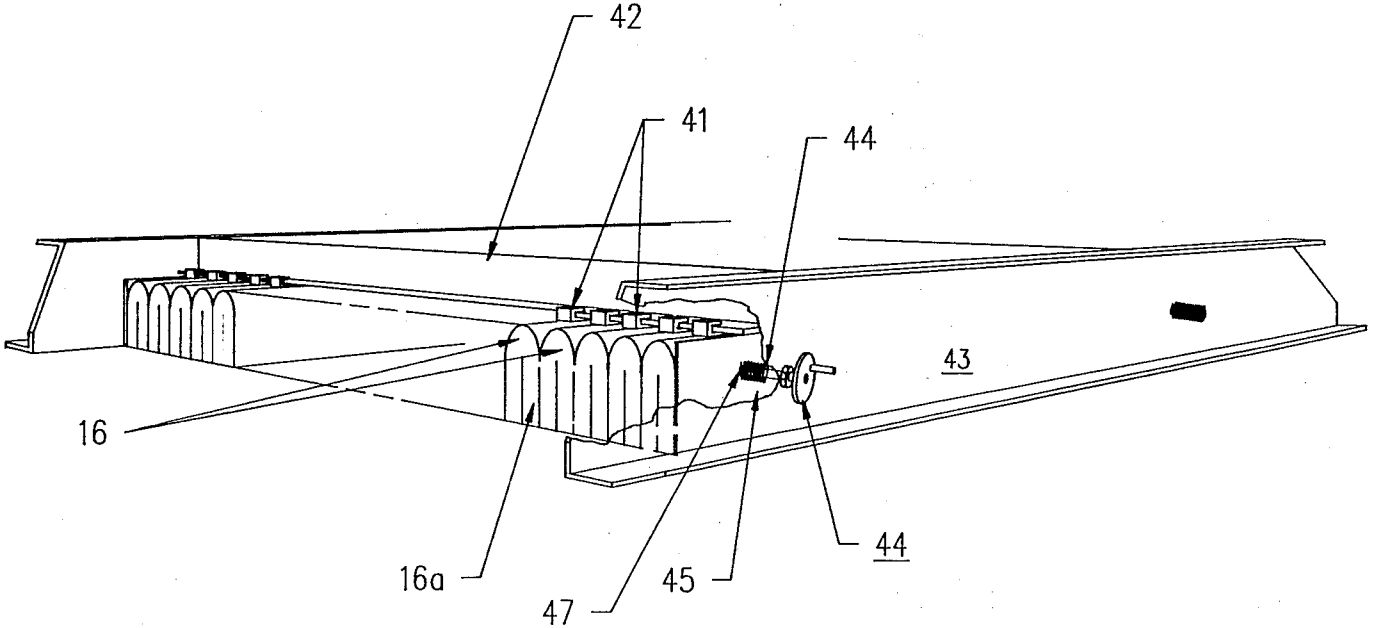
FIG. 5 is a perspective view in partial section of a cover assembly made in accordance with the present invention.

Referring to FIG. 5, a roof or cover particularly adapted for use as a soaking pit cover is shown in partial section. As the principal covering element, U-shaped roof blankets 16 are used. Each of the U-shaped roof blankets 16 has a pair of depending blanket legs 16*a*. A reinforcing bar, not shown, is retained within the fold of each U-shaped roof blanket 16. To each reinforcing bar there are attached posts, also not shown, which pierce through each roof blanket 16 and terminate in a generally C-shaped grip head 41. The grip heads 41 then serve as sliding hangars, griping in this fashion around a portion of a T-bar 42 in slidable engagement. At each end, the T-bar is held in place, as by welding, to end plates, not shown. A spring loaded compression plate 45 abuts against the roof blankets 16. Pressure is exerted by the springs 44 coiled around posts 47 of the spring loaded compression plate 45. The end plates, not shown, are firmly affixed to the furnace chamber structure, by means not shown. In construction, placement of the cover, as over a soaking pit, provides for the resting of the end plates 43 at the edge of the soaking pit, not shown, thereby providing a covered insulation structure of roof blankets 16. As will be seen by referring particularly to the C-shaped grip heads 41, their dimension along the T-bar 4 can be sized to provide for limiting the maximum degree of compression of the roof blankets 16.

Figure 6:
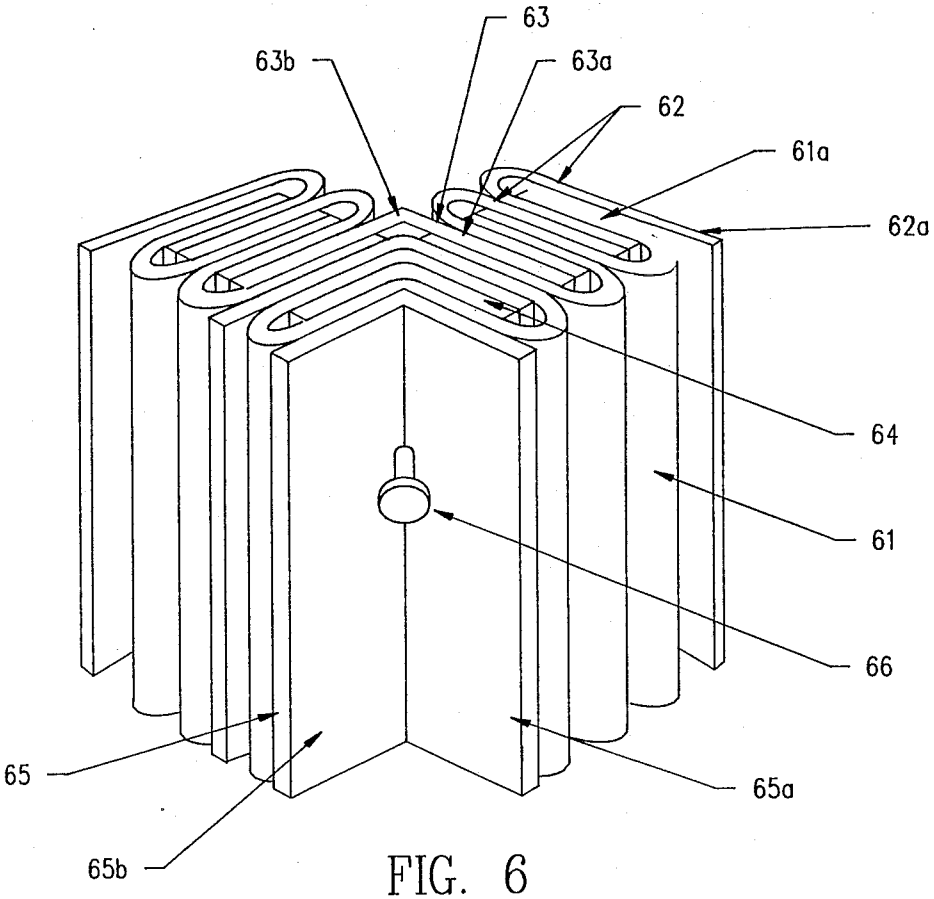
FIG. 6 is a perspective view in partial section of a variation in intersecting furnace wall corner construction.

The corner of the insulation structure, e.g., of intersecting walls, may be arranged so as to transmit compressive force from such corner along each intersecting wall segment. Referring more particularly to FIG. 6, substantially W-shaped ceramic fiber insulation blankets 61 are shown in interengaged manner with substantially U-shaped blankets 62. The U-shaped blankets 62 are inverted in position with respect to the W-shaped blankets 61 such that U-shaped blanket legs 62*a* extend into the spaces between the W-shaped blanket legs 61*a*. A wall-type structure is thereby formed by a continuum of such blankets in series. At the corner section, an L-shaped bridging blanket 63 has one leg 63*a* interengaged in one wall and the remaining leg 63*b* interengaged with the other wall blanket insulation structure. This eliminates potentially destructive heat path through joints at the corner. For additional insulation, a rolled blanket 64 is placed at the outermost corner section. The W-shaped blankets 61 and U-shaped blankets 63 are supported by means not shown, in a manner such as depicted in FIGS. 2-4, and are linked in supportive manner to frame means, also not shown, and also in a manner such as depicted in FIGS. 2-4. The L-shaped bridging blanket 63 is held firmly in place by interengagement of the blanket legs 63*a* and 63*b* with the wall blankets.

A right angle pressure plate 65 abuts against the rolled blanket 64 at the corner in a manner such that one pressure plate leg 65*a* is in parallel relationship with the legs of the W-shaped blankets 61 and U-shaped blankets 62 of one wall whereas the remaining pressure plate leg 65*b* is positioned in parallel relationship with the legs 61*a* and 61*b* of the W-shaped blankets 61 and U-shaped blankets 62 of the adjacent intersecting wall. The right angle pressure plate 65 is compressed against the corner, by force means not shown, transmitted through the threaded sections 66. By this structure, compression against the rolled blanket 64 thereby compresses all of the adjacent W-shaped blankets 61 and U-shaped blankets 62, in side-by-side relationship in each wall, in the direction along each wall. In compression, the pressure plate 65 is insulated from the heat chamber 67 by means of both the rolled blanket 64 and the L-shaped bridging blanket 63. The cornermost W-shaped blanket 61 of each wall, together with rolled blanket 64, thereby provide the corner-forming elements for the wall.

Figure 7:
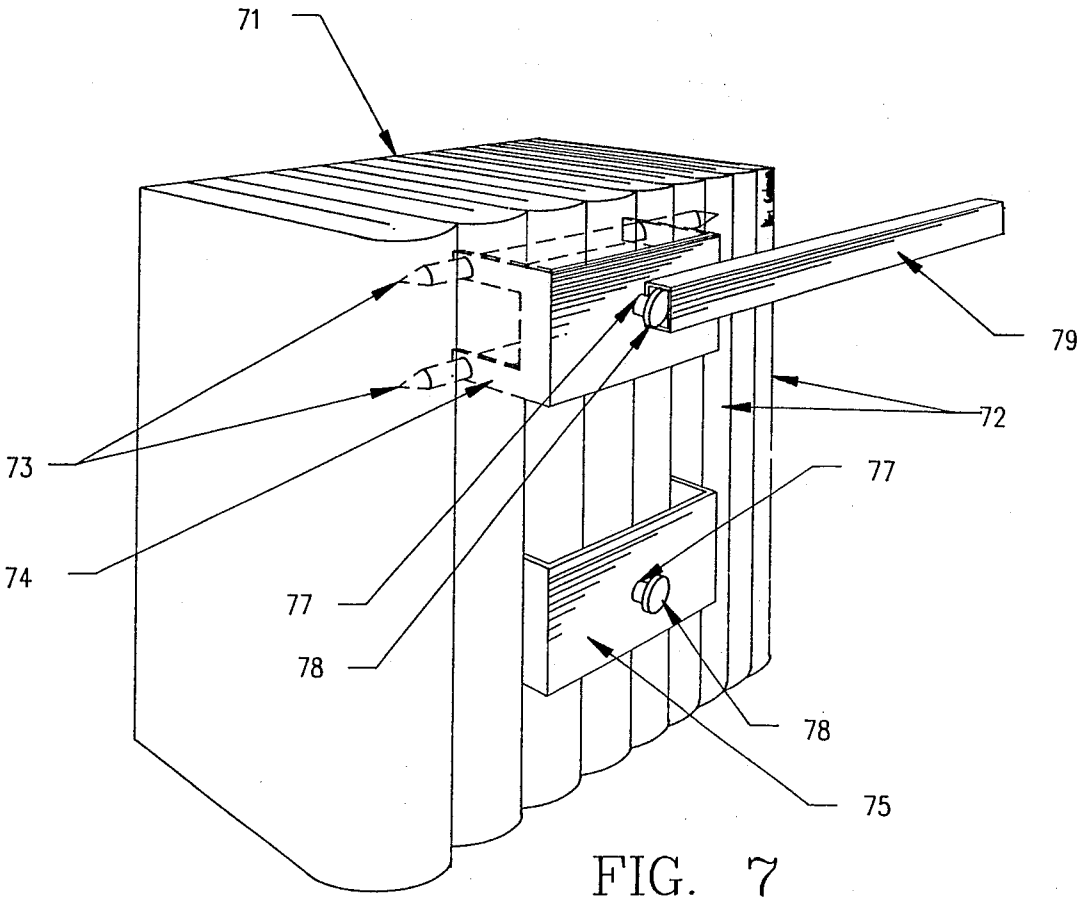
FIG. 7 is a perspective view, in partial section, of a cold face wall portion using ceramic fiber modules.

In FIG. 7 there is depicted the formation of a prefabricated blanket module shown generally at 71. The module 71 is more particularly comprised of a series of U-shaped ceramic fiber blankets 72 in parallel, side-by-side relationship. The blankets 72 are maintained in snug adjacent relationship in part by internal support spikes 73. The support spikes 73 as depicted in phantom in the figure, pierce through the blankets 72 and are employed in pairs. In addition to piercing through the blankets 72, the support spikes 73 are placed in firm engagement through tabs 74 inserted between joints of the blankets 72 from an exterior support plate 75. The support plate 75 is provided with a post leg 77 and post head 78 that are suitable for engagement within a guide channel 79. By such construction, the modules 71 can be prefabricated for placing onto the guide channels 79 and then further placing under compression in use.

Figure 8:
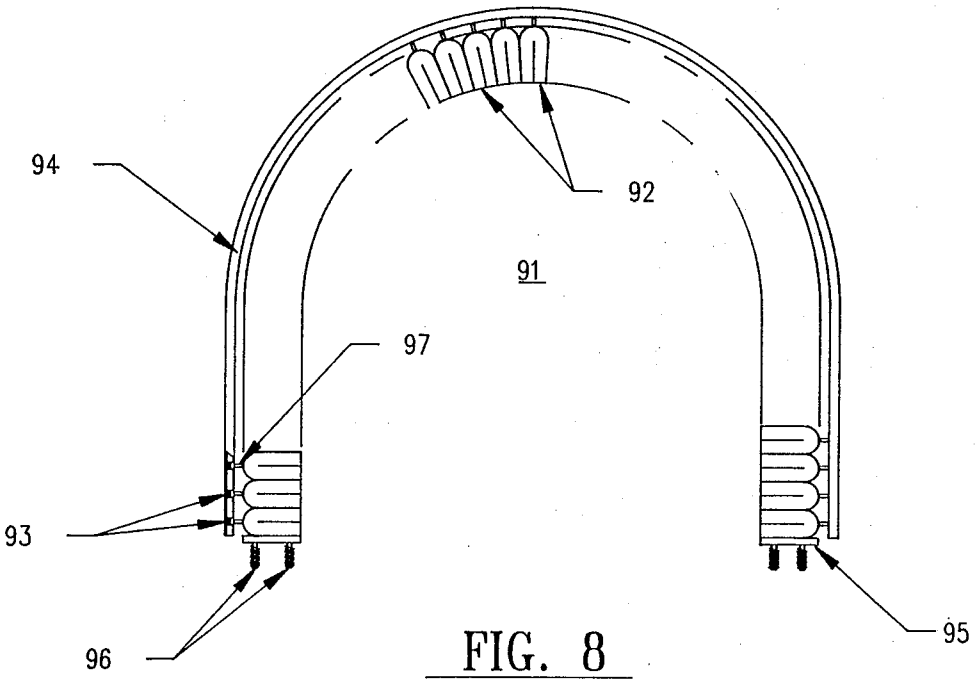
FIG. 8 is a sectional view showing a curvilinear heating chamber wall.

By means of the overhead sectional view of FIG. 8, a curvilinear insulation structure of the present invention is depicted. More particularly, the generally horseshoe-shaped insulation structure is used in part to confine a heat chamber 91. This heat chamber 91 is enclosed by means of ceramic fiber U-shaped blankets 92. The blankets 92 contain reinforcing bars not shown to which there are attached posts 97 which pierce through the blanket and terminate in a post head 93. The post heads 93 interengage with a horseshoe-shaped guide channel 94. A compression plate 95 is then positioned at each end of the leg section of the horseshoe. Compressive force is transmitted through threaded connections 96 to each compression plate 95 by means not shown. It is also contemplated that such structure will be useful in upright position whereby the compression plates 95 exert compressive force upwardly and the horseshoe-shaped structure provides both sides and roof for a heat chamber 91 of generally tunnel shape.

Figure 9:
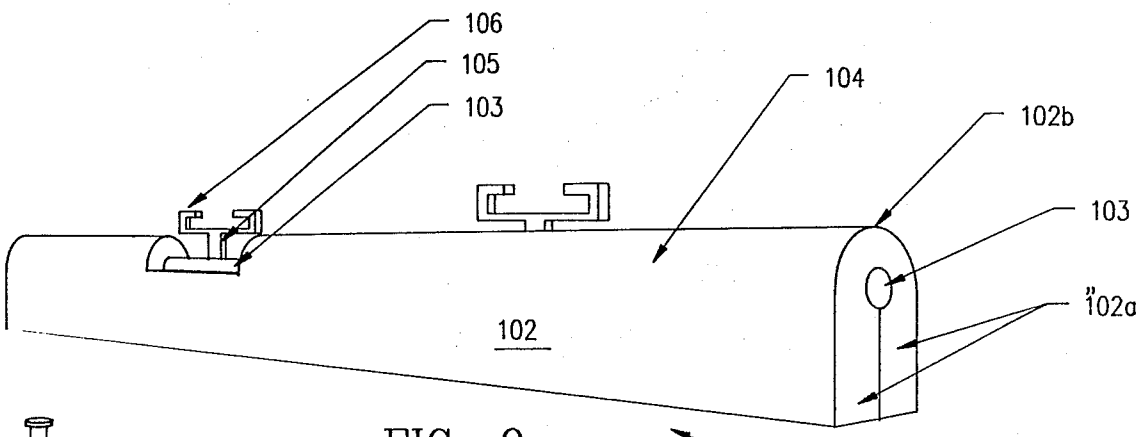
FIG. 9 is a perspective view, in partial section, of a ceramic fiber insulation module.

In FIG. 9 a ceramic fiber insulation module shown generally at 101 is a U-shaped ceramic fiber insulation blanket 102 having depending, parallel blanket leg sections 102*a* and a bridging portion 102*b*. A reinforcing bar 103 is retained in the fold of the blanket 102 as a support element enterengaged at the bridging portion 102*b*. The blanket 102 is generally shaped with broad longitudinal side surfaces 104 which can be snugly engaged, by externally applied pressure means, not shown, against like surfaces of similarly structured ceramic fiber insulation structure, also not shown. Directly, attached to the reinforcing bar 103 are more than one, i.e., a plurality, of engaging posts 105 each of which protrude directly from such bar 103 through the ceramic fiber at the fold thereof and terminate in a C-shaped grip head 106. The grip head is adapted for engagement with a bar element forming a part of a support frame, all not shown. By such post 105 and head 106 assembly, the fiber insulation module 101 can be linked for slidable movement with a support frame.

Figure 10:
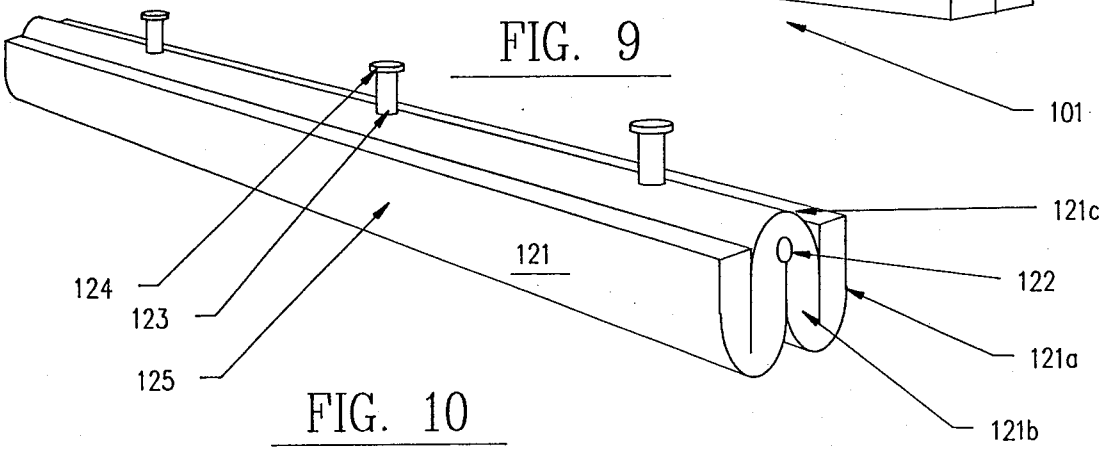
FIG. 10 is a perspective view of a variant for a ceramic fiber insulation module.

In FIG. 10, there is depicted a variant of the fiber insulation module of FIG. 9. More particularly, a W-shaped ceramic fiber insulation blanket 121 has outer parallel leg sections 121*a* presenting broad fiber faces 125 for engagement with similarly structured surfaces, e.g., as found in U-shaped, S-shaped, or other W-shaped modules, not shown. The blanket 121 has inner parallel leg sections 121*b* containing a bridging portion 121*c*. Nestled in the fold between the inner leg sections 121*b*, at the bridging portion 121*c*, is a support rod 122. Directly attached to the support rod 122 are several posts 123 each of which protrudes directly from the support rod 122 at the blanket fold and terminates in a cap, or tab, 124 beyond the ceramic fiber blanket 121. The cap 124 is adapted for engagement with the channel or groove section of a bar element forming a part of a support frame, all not shown. By the post 123 and cap 124 assembly, the module can be linked for slidable movement within a support frame channel. Such modules as depicted in FIGS. 9 and 10 can be particularly serviceable for use in the reconstruction or repair of a heat insulating wall type structure and especially of such structure as taught in the present invention.

Referring again to FIG. 3, during heat chamber operation, as elevated temperatures are obtained and resulting shrinkage of the ceramic fiber mats 6 is encountered, the pressure plate 12 can be spring loaded to provide for automatic shrinkage compensation along the wall. Such shrinkage compensation can be accomplished by any suitable means, e.g., springs, hydraulic, pneumatic or counterbalancing means. Alternatively, it is contemplated that means such as jack screws could be used to exert a constant pressure against the mats 6. During construction or repair of the wall, pressure is released from the pressure plate 12 thereby permitting sliding of the blankets against the pressure plate until the cornermost mat 6 is disengaged from the guide channels 9. Individual mats 6 can then be removed and replacement mats 6, or such replacement modules as shown, for example, in FIG. 10, can be inserted in their place. In such operation, as well as in wall construction, individual mats 6 are merely placed into the wall section by engaging the posts 8 into the guide channels 9 and slidably moving the individual mats 6 along the wall.

It will be appreciated that where construction or repair might be desirable at the corner or in a differing wall section, a structure such as depicted in FIG. 4 can be employed. As shown therein the ceramic fiber blankets 6 can not only be removed or inserted at the corner but also when the flaps 23 in the guide rails 9*a* and 9*b* are opened the reinforcing bars 7 for the blankets 6 may be therein removed or inserted. Such structure will be particularly useful where unitized mat sections, e.g., U-shaped or S-shaped or W-shaped units, are employed in the heat chamber wall. Such unitized structure would also be particularly useful in replacing wall sections removed from the corner.

It is however to be understood that any manner for movably engaging the blanket reinforcing means with the frame means, such as in a manner typically providing a slidable linkage, is contemplated. For example, the reinforcing bars can be replaced by posts that intersect the folded blankets with pointed, elongated members, e.g., spikes or tines and the like, which pierce through the blankets in firm engagement. Also, the C-shaped grip heads could be replaced by rings placed around an exterior support bar. Alternatively, a C-shaped support bar could be interengaged by T-shaped heads located at the ends of the linkage means from the blankets. It is also contemplated that the L-shaped bridging blanket 63 of FIG. 6 could be useful in differing corner construction such as those depicted herein so long as sufficient blanket material is provided in the heat chamber to compensate for wall movement as pressure is exerted against the wall. It is also contemplated that two or more of the L-shaped bridging blankets 63 could be used in an individual corner section, typically in adjacent side-by-side relationship.

Referring again to FIG. 1, the walls and cover of the heat chamber 5 enclosure are of ceramic fiber insulation and it is contemplated, where such might be in use as for example in a slot forge furnace, that the floor of the furnace would be of conventional furnace brick. Likewise the cover need not be as shown in FIG. 1, but can be provided by more conventional furnace construction. For any of the structures as shown herein, ports and inlets can be accommodated in conventional manner. Generally, ceramic fiber insulation blanket compression can be exerted for the insulation around wall ports and inlets thereby providing for enhanced heat retention in the heat chamber. When adjacent blankets are in snug relationship, adjacent faces may be held together in compression alone. However, it is preferred for best reduction of heat loss that such adjacent faces be bound by any conventional technique, most preferably by weaving together, which may also be referred to herein as stitching.

As can be best understood by reference to the drawings, the insulation support means need not be sufficient to insure that insulation blankets will be freestanding. Blanket interengagement and linking of the support means to a frame member can assist in blanket support. Compression can furthermore facilitate such support. The support means thus need be only sufficient to prevent blankets from falling away from the frame, e.g., prevent the roof blankets 16 in FIG. 1 from falling into the heat chamber 5 located below the roof. Moreover, as can also be appreciated by reference to the drawings, the frame members preferably provide a foraminous or open framework, e.g., a lattice-type framework. Thus, girders, channels, beams, rods, reticulated metal covers and the like are most often found as frame and cover members. Such preferred open frame structure can lead to ease of reconstruction and repair. The cold face of the blankets is thus preferably free from base plates, top plates and similar plate-type structure.

Although elements of the overall structures discussed herein, other than the ceramic fiber insulation filler, may generally be considered as metal elements, it will be appreciated that for certain structures lightweight ceramic materials may be suitable. However, the channels are typically rolled metal channels, the plates are metal plates, and so on.

I claim:

1. An insulation assembly for retaining heat in a heat zone, said assembly having an inner ceramic fiber hot face, which assembly comprises:

ceramic fiber insulation in folded, form-stable condition;

support means in interengagement with said insulation;

frame means adjacent said insulation;

linking means engaging said support means with said frame means in movable engagement; and adjustable compression means broadly abutting against said insulation.

2. The insulation assembly of claim 1, wherein said ceramic fiber insulation is present in matrix form as unit structures.

3. The insulation assembly of claim 2, wherein adjacent units are interengaged at least in part in woven condition.

4. The insulation assembly of claim 2, wherein said unit structures include individual, folded U-shaped, S-shaped or W-shaped units.

5. The insulation assembly of claim 4, wherein said folded units are together in a series of parallel, side-by-side units and adjacent units are in snug relationship one with the other.

6. The insulation assembly of claim 4, wherein said compression means abuts against a leg of a cornermost folded ceramic fiber insulation unit.

7. The insulation assembly of claim 5, wherein a leg of one folded unit is in interengagement with the leg of an adjacent folded unit.

8. The insulation assembly of claim 4, wherein said support means internally interengage individual units at folds.

9. The insulation assembly of claim 1, wherein said ceramic fiber insulation is present in at least one, folded and continuous, corrugation-shaped insulation element.

10. The insulation assembly of claim 1, wherein said support means for the insulation comprises rods inserted within folds in said insulation.

11. The insulation assembly of claim 1, wherein said support means for the insulation comprises pointed, elongated members piercing through said fiber insulation.

12. The insulation assembly of claim 1, wherein said frame means comprise an open framework of rigid metal structure spaced apart from said ceramic fiber insulation matrix.

13. The insulation assembly of claim 12, wherein said open framework metal structure includes guide means.

14. The insulation assembly of claim 1, wherein said support means are linked with said frame means by slidable engagement.

15. The insulation assembly of claim 1, wherein said adjustable compression means comprise one or more of screw, spring, hydraulic, pneumatic or counterbalancing means.

16. The insulation assembly of claim 1, wherein said insulation, support means, frame means and engagement means provide a curvilinear wall-type structure.

17. The insulation assembly of claim 1, wherein said insulation, support means, frame means and engagement means comprise an insulated roof structure.

18. The insulation assembly of claim 17, wherein said ceramic fiber insulation is linked to said frame means in depending manner.

19. The insulation assembly of claim 1, wherein said adjustable compression means abuts against said insulation at the corner of intersecting wall-type structures.

20. The insulation assembly of claim 19, wherein said adjustable compression means abuts against a leg of a folded insulation unit in a direction transverse to the unit fold.

21. The insulation assembly of claim 1, wherein said linking means are sized to limit the compression maximum exerted on said insulation.

22. An insulation assembly adapted for shrinkage-compensating condition while having a supported insulation face, said assembly comprising:

a facing of ceramic fiber insulation in folded, form-stable condition;

frame means adjacent the insulation having guide means; and linking means connecting in movable engagement insulation support means with said guide means.

23. The insulation assembly of claim 22, wherein said guide means are channels providing slidable engagement with said linking means.

24. The insulation assembly of claim 22, wherein said frame means comprise a reticulated metal structure spaced apart from said ceramic fiber insulation.

25. A corner insulation assembly for a heat zone, which corner assembly comprises:

ceramic fiber insulation in folded, form-stable condition; and adjustable compression means broadly abutting against said insulation.

26. The corner insulation assembly of claim 25, wherein said adjustable compression means exerts pressure against at least one corner-forming insulation element.

27. The corner insulation assembly of claim 25, wherein said adjustable compression means exerts pressure against more than one corner-forming insulation element.

28. The corner insulation assembly of claim 25, wherein said ceramic fiber insulation is present in matrix form as interengaging, individual folded units, with units in series intersecting as corner-forming elements.

29. The corner insulation assembly of claim 26, wherein said adjustable compression means abuts against a leg of a folded insulation unit in a direction transverse to the unit fold.

30. The corner insulation assembly of claim 28, wherein said units include individual U-shaped, S-shaped or W-shaped units.

31. The corner insulation assembly of claim 28 further characterized by containing at least one L-shaped insulation unit having one leg thereof interengaged with one of said unit series of corner-forming elements, while having the other leg thereof interengaged with another of said unit series of corner-forming elements.

32. The corner insulation assembly of claim 28, wherein said units in adjacent position are interengaged at least in part in woven condition.

33. An insulation cover assembly for retaining heat in a heat zone, said cover assembly having a ceramic fiber hot face, which cover assembly comprises:

ceramic fiber insulation in depending position and folded, form-stable condition as insulation means;

support means in interengagement with said depending insulation;

frame means adjacent to, and at least in part positioned above, said insulation means;

linking means connecting said support means with said frame means in movable engagement; and adjustable compression means broadly abutting against said depending insulation.

34. The insulation cover assembly of claim 33, wherein said ceramic fiber insulation is present in matrix form as unit structures.

35. The insulation cover assembly of claim 34, wherein adjacent units are interengaged at least in part in woven condition.

36. The insulation cover assemblly of claim 34, wherein said insulation unit structures include individual, folded units and said compression means abuts agaisnt a folded insulation unit in a direction transverse to the unit fold.

37. The insulation cover assembly of claim 33, wherein said support means internally interengage individual units at folds.

38. The insulation cover assembly of claim 33, wherein said support means for the insulation comprises rods inserted within folds in said insulation.

39. The insulation cover assembly of claim 33, wherein said support means are linked with said frame means by slidable engagement.

40. The insulation cover structure of claim 33, wherein said linking means are sized to limit the compression maximum exerted on said insulation.

41. A ceramic fiber insulation assembly adapted for repairing a shrinkage-compensating insulation structure having a support frame adjacent a matrix of discrete, folded ceramic fiber insulation units in form-stable condition, with said insulation being under externally applied compression while being linked, by means of insulation support means, in movable engagement with said support frame, said insulation assembly comprising:

at least one unit of folded ceramic fiber insulation in form-stable condition;

at least one support element means in interengagement with said insulation within at least one fold thereof; and a plurality of individual linking members directly engaging said support element, said linking members protruding directly from said support element, beyond the ceramic fiber and from said fold thereof, and terminating in a head configured for sliding engagement with said support frame.

42. The insulation assembly of claim 41, wherein said unit of folded ceramic fiber insulation is U-shaped and said support element comprises a rod interengaging said fiber in the fold at the closed end of the U.

43. The insulation assembly of claim 41, wherein said linking member terminates in a head configured for sliding engagement with said support frame in a direction transverse to the plane of said fold.

44. The insulation assembly of claim 41, wherein said linking member protrudes directly through said ceramic fiber at the fold and terminates in a head containing a hook for engaging a longitudinal member of said support frame for slidable movement thereon in a direction transverse to the plane of said fold.

45. The insulation assembly of claim 41, wherein said linking member protrudes directly through said ceramic fiber at the fold and terminates in a head having a cap for engaging a channel contained within a longitudinal member of said support frame, and for slidable movement within said channel in a direction transverse to the plane of said fold.

46. The method of constructing a supported, adjustable insulating assembly for a heat zone, said assembly facilitating ease of repair while being adapted for reducing heat loss from said zone, which method comprises:

establishing a heat insulating structure of ceramic fiber insulation in folded, form-stable condition;

supporting said insulation;

establishing frame means adjacent said insulation;

linking said support means with said frame means in movable engagement; and adjustably compressing said ceramic fiber insulation by means broadly abutting against said insulation.

47. The method of claim 46, wherein said ceramic fiber insulation is established as a series of side-by-side individual units.

48. The method of claim 46, wherein said insulation is supported by interengaging metal support means therewith.

49. The method of claim 46, wherein said support means slidably engages said frame means.

50. the method of claim 46, wherein said ceramic fiber insulation is spring compressed.

51. The method of constructing a shrinkage-compensating insulation assembly having frame means adjacent a matrix of ceramic fiber insulation in folded, form-stable condition, said method comprising:

linking in movable engagement insulation support means with said frame means; and adjustably compressing said insulation in the direction permitted by said movable engagement by means broadly abutting against said insulation.

52. The method of claim 51, wherein said support means slidably engages said frame means.

53. The method of retaining heat in a heat chamber with shrinkage prone insulation structure using an assembly having frame means adjacent a matrix of ceramic fiber insulation in folded, form-stable condition, with said frame means being spaced apart from insulation support means, said method comprising:

permitting linking of said insulation support means with said frame means in movable engagement; and adjustably compressing said insulation in the direction permitted by said movable engagement by means broadly abutting against said insulation.

54. The method of claim 53, wherein said support means slidably engages said frame means.

55. The method of repairing an insulation assembly having a support frame adjacent a matrix of ceramic fiber insulation units in folded, form-stable condition, with said insulation being under compression exerted externally against same by means broadly abuatting against said insulation, while said insulation is linked, by means of insulation support means, in movable engagement with said support frame, said method comprising:

releasing said external pressure from said matrix of folded ceramic fiber insulation units;

inserting at least one fresh folded fiber insulation unit between pressure exerting means and said matrix of folded ceramic fiber insulation while said matrix is under pressure release;

linking insulation support means for said fresh folded fiber insulation unit in movable engagement with said support frame; and thereafter exerting said external pressure against said fresh fiber insulation unit for pressure transmission through the fiber of said fresh unit to said matrix of folded ceramic fiber insulation.

* * * * *